US005176427A

United States Patent [19]

Weihrauch

[11] Patent Number: 5,176,427

[45] Date of Patent: Jan. 5, 1993

[54] BRISTLE TREATMENT

[75] Inventor: Georg Weihrauch, Wald-Michelbach, Fed. Rep. of Germany

[73] Assignee: Coronet-Werke Heinrich Schlerf GmbH, Wald-Michelbach, Fed. Rep. of Germany

[21] Appl. No.: 663,304

[22] Filed: Mar. 1, 1991

[30] Foreign Application Priority Data

Mar. 1, 1990 [DE] Fed. Rep. of Germany ..... 4006325

[51] Int. Cl.[5] ..... A46D 1/06; A46D 1/08

[52] U.S. Cl. ..... 300/10; 300/11; 300/21

[58] Field of Search ..... 300/7, 10, 11, 21

[56] References Cited

U.S. PATENT DOCUMENTS

| | | | |
|---|---|---|---|
| 2,227,126 | 12/1940 | Cooke | 51/207 |
| 3,102,320 | 9/1963 | Hayes | 300/21 |
| 4,869,277 | 9/1989 | Olsen | 15/167.1 |
| 4,979,782 | 12/1990 | Weihrauch | 300/4 |

FOREIGN PATENT DOCUMENTS

| | | | |
|---|---|---|---|
| 0078569 | 11/1983 | European Pat. Off. . | |
| 0284125 | 9/1988 | European Pat. Off. | 300/11 |
| 0321938 | 6/1989 | European Pat. Off. . | |
| 841483 | 6/1952 | Fed. Rep. of Germany . | |
| 958016 | 2/1957 | Fed. Rep. of Germany . | |
| 2922289 | 12/1980 | Fed. Rep. of Germany . | |
| 3007761 | 4/1982 | Fed. Rep. of Germany . | |

*Primary Examiner*—Mark Rosenbaum
*Assistant Examiner*—John M. Husar
*Attorney, Agent, or Firm*—Antonelli, Terry, Stout & Kraus

[57] ABSTRACT

For the treatment of bristles of brushes, the bristles are fixed in spaced manner from the use-side ends, which are cut to size and subsequently treated by a planar abrading surface arranged at right angles to the bristle extension and all of whose points are moved on circular paths having the same diameter. For setting the contact pressure the abrading surface is fed in the direction of the bristles and for influencing the treatment result the bristles are laterally supported between their fixing point and their use-side ends in a variable spacing from the abrading surface, but which is always the same for all the bristles.

21 Claims, 4 Drawing Sheets

BRISTLE TREATMENT

FIELD OF THE INVENTION

The invention relates to a process and apparatus for treating bristles of brushes, particularly on and in the vicinity of the use-side bristle ends, in that the bristles, which are optionally combined into bundles, are fixed at a distance from their use-side ends, are optionally cut to the desired size at ends and are subsequently treated by an abrading surface positioned substantially at right angles to the bristle extension and all of whose points are moved on circular paths of the same diameter whereby it is possible to vary the pressure of the bristle ends on the abrading surface. The invention is also directed at an apparatus for performing this process.

BACKGROUND OF THE INVENTION

In the case of numerous brushes having plastic bristles and particularly to the extent that they are used for human beings, e.g. as toothbrushes, hand brushes, massage brushes, etc., the sharp-edged bristle ends resulting from the cutting process have to be reworked and in particular rounded. For the sought action of a brush, it is also desirable in many cases to have a different configuration for the surface of the bristles, particularly in the area directly connected to the use-side end as compared with the remaining bristle length, e.g. roughen towards the end, reduce the diameter, etc.

Numerous processes are known for the purpose of the above treatment, processing and working actions and these can be subdivided into thermal, chemical and mechanical processes. In the case of thermal processes the bristle ends are brought to the melting point either directly by heat application (U.S. Pat. No. 2,426,328) or by laser beams (EP-A-0 321 938) and the melt bead formed on each bristle is appropriately treated in order to round the bristle end. In combined chemical-physical processes for producing bristles, which taper towards the ends, bristle ends are either immersed and then removed again from a solvent at a clearly defined speed and the solvent bath is exposed to ultrasonic vibrations (DE-A-30 07 761) or a plastic monofilament is immersed in a viscous liquid and through a corresponding speed pattern on removal it is coated with a surface coating conically tapering towards the end (U.S. Pat. No. 2,207,158).

Another type of process for producing conical bristles is based on a continuous monofilament, which is intermittently tapered after extrusion by a varying stretching speed (DE-C-8 41 483, U.S. Pat. No. 2,341,823) and cutting to bristles takes place in the vicinity of the taper, or hollow monofilaments are produced (U.S. Pat. No. 3,184,822) and they are thermally compressed towards the end after cutting. In addition, bristles are known in which, for improving the cleaning action, the bristle surface is profiled (U.S. Pat. No. 2,317,485) and/or roughened (U.S. Pat. No. 2,862,284).

The invention deals exclusively with a mechanical process. As such planing, milling and grinding or abrading, optionally in combination with one another are known. For the production of toothbrushes, whose bristles are located in a contoured surface, the longer bristles are initially outwardly displaced in rows by wedge-shaped slide-in units, the shorter bristles are laterally grasped, cut to size and abraded at their ends and then following the removal of the slide-in units the longer bristles are abraded (EP-0 078 569). In another known process (U.S. Pat. No. 2,227,126) with a combined milling and grinding treatment the toothbrushes or their bristles are guided over the circumferential surface of several rotating disk tools, whose surfaces are hollowed out in cavetto-like manner and differently profiled. The bristle contour is obtained by a corresponding movement path of the brushes. In order to cut the bristles to the desired contour prior to processing, between the individual bristle rows are inserted comb-like ledges, which are of varying height and above which the bristles are cut to size. In order to individually support each bundle, it is also possible to insert further bars at right angles to the ledges. The actual treatment of the ends is complicated due to the large number of different tools and the result thereof is not satisfactory, because the bristles or bristle bundles are at different angles to the treatment surface.

In the aforementioned, known process (DE-C-9 58 016, DE-A-29 22 289), which forms the basis for the present invention, the bristle ends are worked by a planar abrading surface rotating about two axes. The abrading surface is positioned at right angles to the bristles. As a result of the circular movement of each point of the abrading surface, in the case of a corresponding pressure of the bristles it is ensured that the end of each bristle is uniformly rounded. It is possible to vary the pressure action (DE-C-9 58 016), in that the holder fixing the brush is adjustable by means of threaded spindles and nuts. Initially a higher pressure is used and consequently a greater bending or deflection of the bristles and subsequently the holder is removed from the abrading surface. However, due to the considerable free length of the bristles and the resulting differing bending behavior, as well as the possibility of the unimpeded deflection of the bristles, particularly in the outer portions of the brush, this process also fails to bring about a uniform rounding of all the bristle ends. It is also not possible to treat contoured brushes.

SUMMARY OF THE INVENTION

The aim underlying the present invention resides in further developing the aforementioned process, so that it is possible to bring about a completely satisfactory treatment of the ends in the case of any random brush contour and, if necessary, it is also possible to treat the bristle surface in a zone extending from the bristle end towards the fixing point. A further aim of the invention is to provide a suitable apparatus for performing this process.

On the basis of the aforementioned process, the bristles, optionally in bundles, are supported by the abrading surface with a variable spacing, but which is always the same for all the bristles, between their fixing point and their use-side ends in order to influence the result of the treatment.

In the process according to the invention, the bristles are fixed as short cut portions or as a part of endless monofilaments with a distance from the bristle ends roughly corresponding to the final length. A clamping device, used in the production sequence for the brush, can be used for fixing the bristles in the configuration essential for the finished brush, or it can be the brush body or a part thereof in which the bristles are inserted during the production sequence. Generally, after fixing, the bristles are cut to the desired length and are subsequently treated and, in particular, rounded at the ends by abrasion. The abrading pressure necessary for the treatment of the ends is preferably produced by feeding the abrading surface towards the bristle ends, with it being possible to vary the abrading pressure during the treatment. As the length of the bristles can vary as a function of the type of brush to be produced, while the abrading pressure and therefore the treatment result are decisively dependent on the bristle length, i.e. the bristles yield to or escape from the abrading pressure to a varying extent as a function of the length and position within the bundle or brush, the bristles are additionally laterally supported between their fixing point and the free bristle ends. This lateral support can be varied, so as to e.g. ensure for all the bristles an identical free length and, consequently, ensure that, during abrasion, a uniform abrading pressure is applied to all the bristle ends. In addition, by varying the spacing of the lateral support from the bristle ends it is possible to influence the treatment result, namely, the nature of the rounding, so that it is possible to produce at the bristle ends flat cones, part spherical or part ellipsoidal shapes.

As indicated hereinbefore it is admittedly known in connection with the cutting of bristles (U.S. Pat. No. 2,227,126), to laterally support individually or in rows the bristle bundles, but this measure mainly serves for producing a contoured brush surface. The prior art does not consider the lateral support to be vital for abrading purposes.

In the case of many brushes, the bristles or bristle bundles are not positioned at right angles to the fixing plane on the brush body and instead extend under angles differing from 90°. It is in fact frequently the case that the bristles or bristle bundles are at different angles. However, in order to ensure a uniform treatment of the ends for all the bristles, according to the invention, the bristles are so laterally supported at a distance from the fixing plane and so laterally displaced by the support, that they are at right angles to the fixing plane or abrading surface between the support and the bristle ends and the abrading surface is fed into this.

According to the aforementioned embodiment the bristles or bristle bundles are not only laterally supported within the scope of their predetermined angular setting, but by a lateral displacement of the support with respect to the fixing plane are brought into a position at right angles to the abrading surface, i.e. are bent away under a complementary angle to the fixing plane, so that the abrading surface acts on all the bristles with the same positioning. After abrading and after removing the lateral support, the bristles reassume their original predetermined angular position over their entire length.

The aforementioned process variant can be combined with the cutting process in such a way that, following lateral displacement, the bristle ends are cut to the desired size directly above the support, the support is then moved in bristle-parallel manner while increasing the distance from the bristle ends and then the abrading surface is fed in.

As a result of the supporting of the bristles or bristle bundles in accordance with the invention, they can be cut to the same length despite the different angular setting, with the bristles being supported directly below the cutting plane. After cutting, the bristles are laterally supported at a greater distance from the bristle ends and, subsequently, their ends are abraded.

For the case particularly encountered with toothbrushes, the bristles or bristle bundles have a different free length so as, in this way, to form a contoured brush surface, according to another embodiment of the invention a treatment result which is the same for all the bristles is ensured that, depending on their length between the fixing plane and the lateral support, the bristles are laterally deflected at right angles to their extension until the ends of all the bristles are in one plane and then the abrading surface is fed in.

As a result of the deflection of the longer bristles compared with the shorter bristles below the support plane, it is also possible to ensure that the bristle ends are all in a common plane, so that the same conditions as regards abrading pressure and free length then apply to each bristle during subsequent abrasion.

The process according to the invention also makes it possible to work the bristle surface in the vicinity of the bristle ends, e.g. in order to roughen, point or similarly treat the bristles, in that e.g. the abrading surface is preferably suddenly fed in to such an extent that the bristles are bent away in one direction and the surface thereof connected to the bristle end engages on the abrading surface. The length of the bristle surface or envelope engaging on the abrading surface and therefore the treated length of the bristle can again be influenced by the lateral support of the bristles. The smaller the distance of the support from the abrading surface, the smaller the bent away bristle length.

In another embodiment with the same aim, the abrading surface and the fixing plane are displaced parallel to one another from a position in which the abrading surface is laterally positioned relative to all the bristles and the distance between the two is smaller than the bristle length, so that the bristles are bent away counter to the displacement direction and engage with the surface area to be treated on the abrading surface. The treatment length on the bristle surface can be very accurately preset by a corresponding spacing change of abrading surface and fixing point prior to the movement of the abrading surface into the abrading position. In both the aforementioned embodiments of the process it is optionally possible to obviate the separate, spacing-variable supporting of the bristles.

For the performance of the process, the invention is based on a known apparatus (DE-C-9 58 016), which has a fixing device optionally fixing the bristles in bundles, a cutting device for cutting the bristles to the desired length and an abrading member, which has an abrading surface arranged substantially at right angles to the bristle extension and which is driven by eccentrics in such a way that each point of the abrading surface moves on a circular path of the same diameter. The known apparatus also has a device for varying the spacing between the fixing device and the abrading surface. Such an apparatus is inventively characterized in that at a distance from the fixing device is provided in a plane parallel to the abrading surface a support largely embracing the bristles or individual bristle bundles on all sides and which can be moved parallel to the bristles. It is optionally possible to proceed in such a way that the abrading member has a feed drive forming the device for modifying the spacing.

In order to be able to uniformly treat bristles, which are at an angle to the abrading surface differing from 90°, an embodiment of the inventive apparatus is characterized in that the support is displaceable parallel to the abrading surface.

The support can simultaneously serve as a shear surface for the abrading device. In this construction the support is firstly brought into the position intended for cutting the bristle ends to size and subsequently the cutting device is moved over the support and the bristles are cut to size. The support is then moved away from the bristle ends until there is a given, free bristle length. The abrading disk is then fed in and the treatment process commences. It is also possible to provide two or more supports for this purpose, which are movable in bristle-parallel manner independently of one another and whereof the support close to the bristle ends forms the shearing surface and the two together form the support during abrading.

In order to be able to treat or work bristles of different lengths, between the fixing device and the support a device is provided for deflecting the bristles from their stretched position which engages between the bristles or the individual bristle bundles and moves at right angles thereto. As with brushes having different bristle lengths the differences are generally within narrow limits, the bundle spacing is generally sufficient to have adequate space between the bundles for the necessary deflection.

The apparatus is also characterized in that the abrading member can be moved from a position alongside the bristles fixed by the fixing device, in which its spacing from the support is smaller than the free length of the bristles, parallel to the support and into the abrading position. Thus, on feeding the abrading member into the abrading position the bristles are so bent down by the abrading surface that they engage on the latter with part of their surface and, consequently, the latter can be worked.

The support can be formed by comb-like ledges engaging between the bristles or bristle bundles. The ledges are preferably arranged at a limited distance from one another and have on their facing sides and in the grid predetermined by the arrangement of the bristles or bristle bundles, recesses laterally surrounding the same.

In this embodiment the ledges can be introduced from the side between the bristles or bristle bundles and between two adjacent ledges each bundle of a row of bundles is laterally supported in all directions. The leading ends of the ledges are pointed in order to facilitate insertion.

In place of a ledge-like construction with recesses surrounding the bundles, the construction can also be such that the support is formed by comb-like bars engaging between the bristles or bristle bundles.

In the aforementioned embodiment the bristles are substantially only supported in an adequately stable manner in two directions at right angles to one another. An all-sided support can be achieved in that two groups of comb-like bars engaging between the bristles or bristle bundles and which are at right angles to one another are provide, with the adjacent bars of both groups in each case surrounding a bristle or bristle bundle.

The embodiment with the comb-like bars is particularly advantageous when there is a close bristle spacing, so as to be able to still introduce the lateral support from the side between the bristle bundles.

Finally, the device for deflecting the bristles can also comprise individual bars, which are inserted between the bristles or bristle bundles and between the fixing plane and the support from the side and which are displaceable at right angles to the bristles. Here again it is advantageous to have two or more supports between which are located the bars of the deflecting device. The supports and bars of the deflecting device move simultaneously or successively between the bristle bundles. The bars of the deflecting device only engage in the vicinity of the longer bristle bundles and, by transverse displacement between the supports, deflect the latter to such an extent that all the bristle ends are roughly in one plane. Only then is the abrading member fed in and the ends worked.

BRIEF DESCRIPTION OF THE DRAWINGS

The invention is described in greater detail hereinafter relative to nonlimitative embodiments and the attached drawings, wherein.

Figure 1:
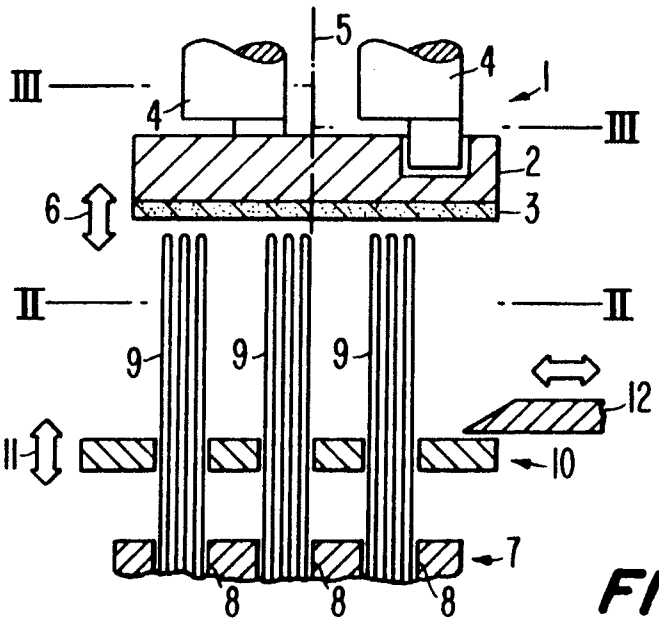
FIG. 1 is a schematic partial cross-sectional view of a first embodiment of the apparatus constructed in accordance with the present invention.

DETAILED DESCRIPTION:

The apparatus according to FIG. 1 has an abrading member 1 with an abrading member carrier 2, which, in turn, has a planar abrading surface 3 applied to the carrier 2 as a layer. The abrading member in the illustrated embodiment is moved by three eccentrics 4 (FIG. 3) in a circular movement about an axis 5. For this purpose at least one of the eccentrics 4 is driven. Therefore, the abrading surface 3 performs the circular movement indicated by direction arrows in FIG. 3, in which each point of the abrading surface 3 moves on a circle with the same diameter. The abrading member 1 can also be fed in the direction of the double arrow 6 (FIG. 1). The infeed movement is brought about by a hydraulic or spindle drive (not shown).

The apparatus can also have a fixing device 7, which has a plurality of passage holes 8, arranged in a grid pattern corresponding to that of the bundle arrangement on the finished brush and having a diameter substantially corresponding to the bundle diameter. This fixing device can be in the form of a clamping device, so that the bristle bundles 9, inserted in the holes 8, can optionally be additionally closely fixed. In place of an apparatus fixing device 7, the latter can be directly formed by the bristle carrier of the brush, to which the bristle bundles 9 are already fixed.

The apparatus also has a lateral support 10, which laterally supports the bristle bundles 9 at a distance from the plane predetermined by the fixing device 7. The support 10 is movable in bristle-parallel manner in the direction of the double arrow 11. The apparatus can also have a cutting device 12 in the form of a cutting blade extending over the entire bristle area.

Figure 2:
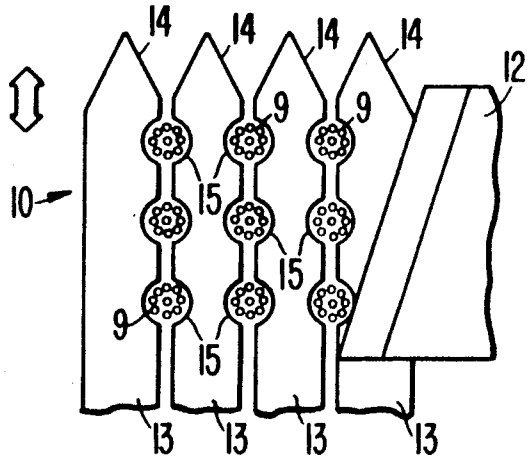
FIG. 2 is a sectional view taken along the line II—II in FIG. 1.

According to a preferred embodiment shown in greater detail in FIG. 2, the support 10 comprises parallel ledges 13, which can be introduced from the side between the bristle bundles 9 and, for this purpose, taper at their ends 14. The ledges 13 are juxtaposed with a limited spacing and have on their facing sides pitch circular recesses 15, so that facing recesses are approximately summated to form a circular shape and, in the inserted position completely surround a bristle bundle 9. The ledges shown in FIG. 2 and which can only be moved in and out in one direction can be replaced by linear bars for forming the support. There are then two groups of bars at right angles to one another and which can be inserted in comb-like manner between the bristle bundles 9, so that a bristle bundle 9 is laterally supported between adjacent, crossing bars.

Figure 3:
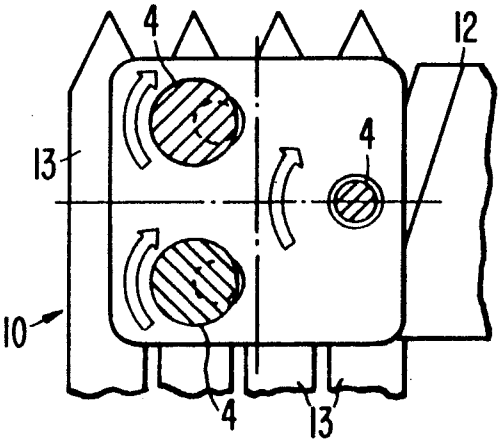
FIG. 3 is a cross-sectional view taken along the line III—III in FIG. 1.
Figure 4A:
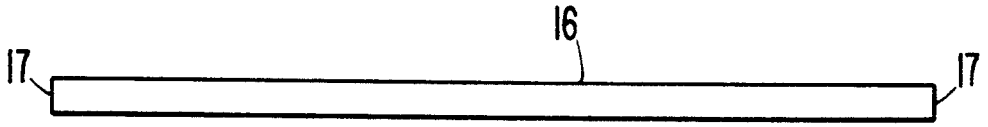
FIGS. 4*a*–4*e* are schematic enlarged views of individual bristles with differently worked ends.
Figure 4B:
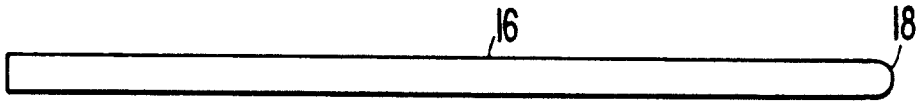
Figure 4C:
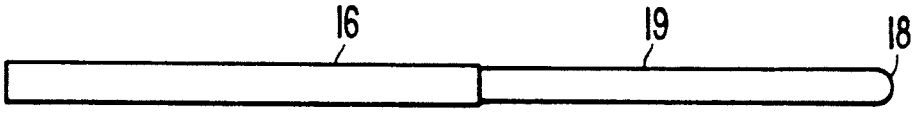
Figure 4D:
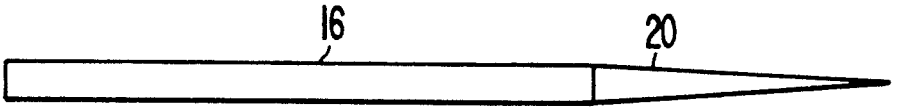
Figure 4E:
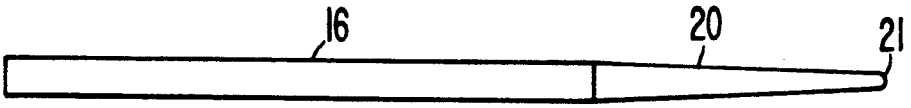

Using the apparatus shown in FIGS. 1 to 3 the bristles within a bundle can be processed, treated or worked in the manner shown in FIGS. 4*a*–4*e*. A single bristle 16 initially has the form shown in FIG. 4*a*. It is e.g. cylindrical and has cuts 17 at both ends at right angles to the axis thereof. Such a bristle 16 can merely be rounded at its end, as indicated at end 18 in FIG. 4*b*. In addition, in its portion 19 near the rounded end 18, the bristle 16 can be roughened (FIG. 4*c*). Instead of this it is also possible to point the portion 20 towards the end, so that in the vicinity of the end, the bristle 1l has a greater flexibility (FIG. 4*d*) and the tip 21 at the end of the conically tapering portion 20 can be rounded (FIG. 4*e*).

Figure 5C:
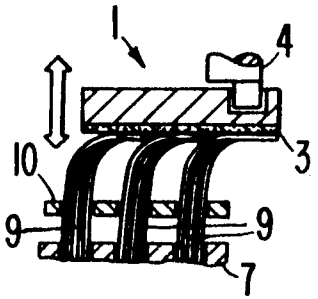
FIGS. 5*a*–5*c* are schematic views of the apparatus of the present invention with a different treatment process.
Figure 5B:
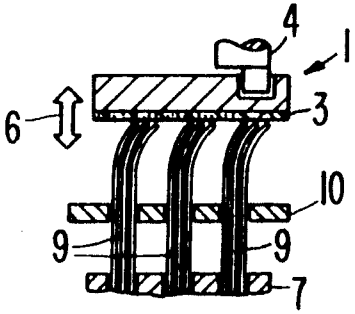
Figure 5A:
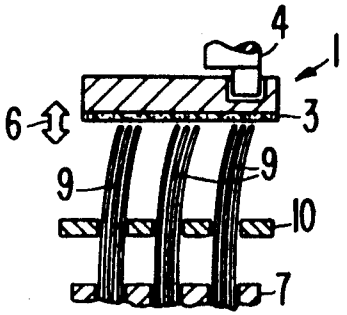

FIG. 5*a* shows the conventional processing operation when rounding bristle ends. For this purpose, the support 10 is located at a predetermined distance from the fixing device 7, so that the bristle bundles 9 project over the support 10 by a length allowing the desired amount of deflection or bending. The abrading member 1 is fed in downwardly in the direction of the double arrow 6 until the bristle bundles 9 bend away by a small amount and, in this position, the bristle ends are abraded. During abrasion the abrading member 1 can be fed in continuously or discontinuously, so as to obtain a perfectly rounded transition from the bristle end to the bristle surface, or to contour the bristle end in a specific manner (FIG. 5*b*). As a result of a more marked infeed, which can, in particular, take place suddenly, a more pronounced bending away of the bristle bundles can be achieved, as shown in FIG. 5*c*. This can also be achieved in another way in that the abrading member 1 is moved with the spacing shown in FIG. 5*c* from a position outside the bristle bundle and from the side into the abrading position, the abrading surface 3 correspondingly bending down the bristle bundles. In the position according to FIG. 5*c*, the bristles can be worked on their surface, e.g. by roughening or pointing. In the case of such a treatment of the bristle surface, the working of the bristle ends preferably takes place following onto the treatment shown in FIG. 5*c*.

Figure 6C:
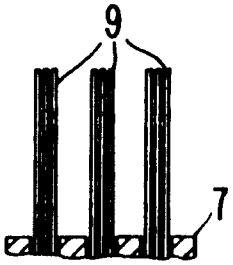
FIGS. 6*a*–6*c* are schematic views illustrating different phases during cutting of bristles and treatment of the bristle ends.
Figure 6B:
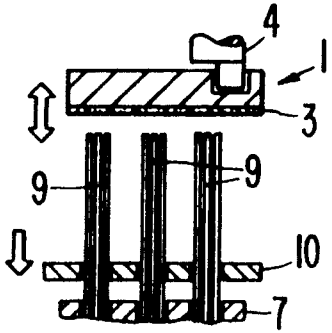
Figure 6A:
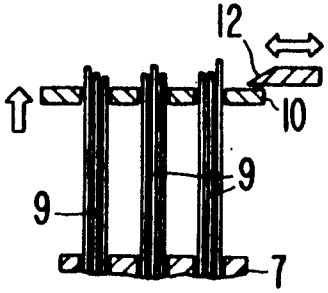

In FIG. 6*a* the bristle bundles 9 are once again held by the fixing device 7. In this case the support 10 initially serves as a shear surface for the cutting device 12. After inserting between the bristle bundles, the support 10 is firstly moved upwardly to the bristle end. In the position shown in FIG. 6*a* in which the varyingly long bristles project to a varying extent over the support 10, the cutting device 12 moves away over the support 10 and brings the bristles to the same length in the manner shown in FIG. 6*b*. The support 10 then moves downwards into its position for the abrading process and the abrading member 1 is fed in. After abrading the ends of the bristle bundles 9 are rounded in the manner shown in FIG. 6*c*.

Figure 7D:
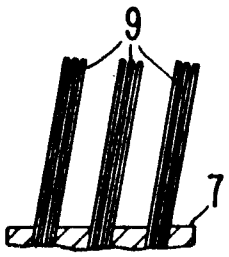
FIGS. 7*a*–7*d* are schematic views of different phases during treatment of angularly set bristles.
Figure 7C:
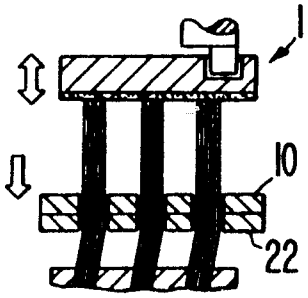
Figure 7B:
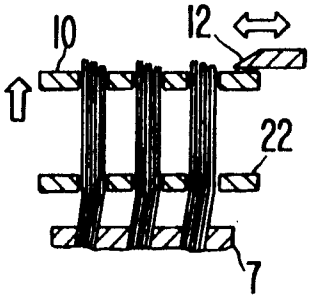
Figure 8B:
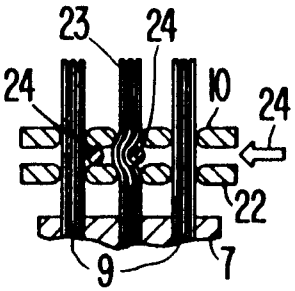
Figure 7A:
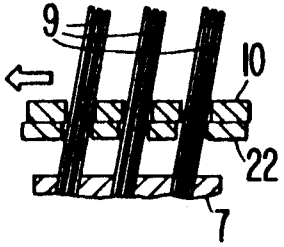

FIG. 7*a* shows a fixing device 7, in which the bristle bundles 9 are held in a position differing from 90°. For this bristle bundle configuration there are two supports 10, 22, which are introduced so as to engage on one another between the bundles 9. As shown in FIG. 7*b*, the supports 10, 22 are then moved at right angles to the bristle bundles 9, so that the latter are vertically oriented with respect to the fixing device 7. The upper support 10 again moves upwardly close to the bristle ends and forms there a shearing surface for the cutting device 12. The support 10 is then again brought downwards so as to engage on the support 22, so that the bristle portions projecting upwardly over the support 10 are still perpendicular to the planar abrading surface 3. The abrading member 1 is then fed in and the bristle ends are worked. After moving away the abrading member 1 and removing the supports 10, 22, the bristle bundles 9 again assume the angular position with respect to the fixing device 7 shown in FIG. 7*d*. The ends of all the bristles of the bundle 9 are uniformly rounded.

FIGS. 8*a* to 8*d* illustrate the treatment of a bristle arrangement within which the bristle bundles have different lengths. This is e.g. the case with brushes, in which the bristle ends are located on a contoured surface.

Figure 8D:
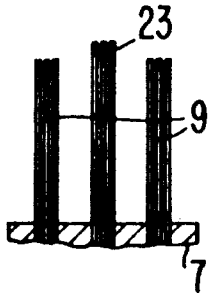
FIGS. 8*a*–8*d* are schematic views of different phases during treatment of bristle bundles of varying length.
Figure 8C:
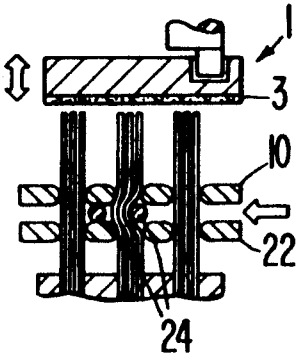
Figure 8A:
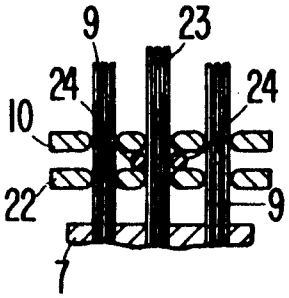

Here again the bristle bundles 9 are fixed in a fixing device 7. However, apart from the bristle bundles 9 of the same length, there is at least one longer bristle bundle 23 (FIG. 8*a*). In this case the apparatus once again has two supports 10, 22, which are spaced not only from the fixing device 7 but also from one another. In the vicinity of the long bristle bundle 23 a device 24 engages between the two supports 10, 22 and it is formed in the represented embodiment by two parallel bars 24, which are arranged at a distance from one another which roughly corresponds to the diameter of the bristle bundle 9 and which fix the bristle bundle 23 between them. The bars 24 are displaceable at right angles to the bristle extension, as illustrated by the arrow 24 in FIG. 8*b*. In this displacement movement the bars 24 laterally deflect the bristle bundle 23 between the supports 10 and 22. The extent of the displacement movement is chosen in such a way that the ends of the bristle bundle 23 are located in a plane with the ends of the bristle bundle 9 (FIG. 8*c*). The abrading member 1 is then fed in in order to work the ends of the bristles. After moving away the abrading member and moving out the supports 10, 22 together with the bars 24, the bristle bundle 23 again passes into the extended position (FIG. 8*d*), so that the ends of all the bristle bundles 9, 23 are uniformly rounded.

I claim:

1. Process for treating a use side end of bristles of brushes the process comprising the steps of:

fixing the bristles at a distance from the use side ends, abrading said use side ends of said bristles by an abrading surface positioned substantially at right angles to an extension of the bristles and having all abrading points moved on circular paths of the same diameter, supporting the bristles by the abrading surface with a variable spacing, but which is always at an identical spacing for all of the bristles between a fixing point of the bristles and said use-side ends to control a configuring of the use-side ends.

2. Process according to claim 1, wherein the bristles extend at an angle to a fixing plane which differs from 90°, the method further comprising the steps of:

laterally supporting the bristles at a distance from a fixing plane containing the fixing point, laterally displacing the bristles by the lateral support in such a manner that the bristles pass between the support and the bristle ends at right angles to at least one of the fixing plane and the abrading surface, and feeding the abrading surface in a direction of the bristle ends.

3. Process according to claim 2, wherein, following the step of laterally displacing, initially cutting the bristle ends to a desired size immediately above the lateral support, and then moving the support in parallel to the bristles while increasing a spacing from the bristle ends, and then feeding the abrading surface in a direction of the bristle ends.

4. Process according to claim 1, wherein the bristles have a different length, the method further comprising the steps of laterally deflecting the bristles, as a function of their length at right angles to an extension thereof between a fixing plane containing the fixing point and a lateral support until the use-side ends of all of the bristles are located in one plane, and then feeding the abrading surface a direction of the bristle ends.

5. Process according to one of claims 1, 2, 3 or 4, wherein the abrading surface is fed in such a manner that the bristles are bent away in one direction and engage on an abrading surface.

6. Process according to one of claims 2 or 3, wherein the abrading surface and the fixing plane are displaced parallel to one another from a position in which the abrading surface is located laterally of all the bristles and the distances between the fixing plane and abrading surface is less than a length of the bristles in such a manner that the bristles are bent away opposite a displacement direction and engage on the abrading surface with an area of the surface of the bristles to be treated.

7. Process according to one of claims 1 to 4 further comprising the step of adjusting a pressure applied by the abrading surface on the bristles.

8. Apparatus for treating use-ends of bristles of brushes, the apparatus comprising:

a fixing device for fixing the bristles, a cutting device for cutting the bristles to a desired length and an abrading member with an abrading surface disposed substantially at right angles to an extension of the bristles, eccentric drive means for driving the abrading surface such that each point of the abrading surface moves on a circular path of the same diameter, a device for varying a spacing between the fixing device and the abrading surface, a support provided at a distance from the fixing device, said support surrounding the bristles substantially on all sides and being adapted to be movable in parallel to the bristle in a plane parallel to the abrading surface.

9. Apparatus according to claim 8, wherein the device for varying the spacing between the abrading surface includes an infeed drive for the abrading member.

10. Apparatus according to claim 8, wherein the support is displaceable in a direction parallel to the abrading surface.

11. Apparatus according to one of claims 8, 11 or 12, wherein the support simultaneously serves a shear surface for the cutting device.

12. Apparatus according to claim 11, wherein at least two parallel supports are provided, each forming the shear surface.

13. Apparatus according to claim 12, wherein the parallel supports are movable independently of one another.

14. Apparatus according to claim 8 further comprising a device disposed between the fixing device and the support for deflecting the bristles from an extended position and engaging between the bristles, and wherein the device for deflecting is displaceable at right angles to the bristles.

15. Apparatus according to claim 14, wherein the device for deflecting the bristles comprises individual bars insertable between the bristles, and wherein the individual bars are displaceable at right angles to the bristles.

16. Apparatus according to claim 8, wherein the abrading member is movable from a position alongside the bristles to a position parallel to said support into an abrading position, and wherein a distance between the support and the abrading member is less than a free length of the bristles.

17. Apparatus according to claim 8, wherein the support includes ledges engaging as a comb between the respective bristles.

18. Apparatus according to claim 8, wherein the ledges are positioned at a predetermined distance from one another and in a grid pattern predetermined by the arrangement of the bristles and includes recesses for laterally surrounding the bristles.

19. Apparatus according to claim 18, wherein the ledges are movable from a side between the bristles and includes pointed leading ends.

20. Apparatus according to claim 8, wherein the support includes bars engaging as a comb between the respective bristles.

21. Apparatus according to claim 20, wherein at least two groups of bars are disposed at right angles to one another, and wherein adjacent bars of the groups surround the respective bristles.

* * * * *